US009570827B2

(12) United States Patent
Kurita et al.

(10) Patent No.: US 9,570,827 B2
(45) Date of Patent: Feb. 14, 2017

(54) CONTACT MEMBER

(71) Applicant: KITAGAWA INDUSTRIES CO., LTD., Aichi (JP)

(72) Inventors: Tomohisa Kurita, Kasugai (JP); Hideo Yumi, Kasugai (JP)

(73) Assignee: KITAGAWA INDUSTRIES CO., LTD., Aichi (JP)

( * ) Notice: Subject to any disclaimer, the term of this patent is extended or adjusted under 35 U.S.C. 154(b) by 0 days.

(21) Appl. No.: 14/928,501

(22) Filed: Oct. 30, 2015

(65) Prior Publication Data

US 2016/0126653 A1 May 5, 2016

(30) Foreign Application Priority Data

Oct. 31, 2014 (JP) ..... 2014-222985

(51) Int. Cl.

| | |
|---|---|
| ***H01R 13/15*** | (2006.01) |
| ***H01R 13/02*** | (2006.01) |
| ***H01R 12/00*** | (2006.01) |
| ***H01R 13/24*** | (2006.01) |

(52) U.S. Cl.

CPC ..... *H01R 13/15* (2013.01); *H01R 9/096* (2013.01); *H01R 13/02* (2013.01); *H01R 13/2442* (2013.01); *H01R 13/2478* (2013.01)

(58) Field of Classification Search

CPC ..... H01R 13/15; H01R 13/2457; H01R 11/01; H01R 11/07; H01R 11/05; H01R 9/096

See application file for complete search history.

(56) References Cited

U.S. PATENT DOCUMENTS

| | | | | |
|---|---|---|---|---|
| 3,504,095 | A * | 3/1970 | Roberson | H05K 9/0016 174/355 |
| 5,029,254 | A * | 7/1991 | Stickney | H02B 1/16 174/354 |
| 6,300,579 | B1 * | 10/2001 | Yumi | H01R 9/091 174/267 |
| 6,719,569 | B2 * | 4/2004 | Ochiai | H01R 13/2485 439/66 |
| 7,070,420 | B1 * | 7/2006 | Wakefield | H01R 13/2414 439/66 |
| 8,057,254 | B1 * | 11/2011 | Yang | H01R 11/286 439/500 |

(Continued)

FOREIGN PATENT DOCUMENTS

| | | |
|---|---|---|
| EP | 1448041 A2 | 4/2004 |
| JP | 4-2464 | 1/1992 |

(Continued)

*Primary Examiner* — James Harvey
(74) *Attorney, Agent, or Firm* — Koppel, Patrick, Heybl & Philpott

(57) ABSTRACT

A contact member according to one aspect of the present disclosure comprises: a thin plate member having spring characteristics and electrical conductivity. The thin plate member comprises: a joint portion having a joint surface to be joined to a first member; a contact portion contactable with a second member; and a connecting portion having a length component in a direction intersecting the joint surface, and having a first end continuous to the joint portion and a second end continuous to the contact portion. The connecting portion comprises a narrow portion having a smaller dimension in a width direction than a dimension around the narrow portion.

14 Claims, 10 Drawing Sheets

(56) References Cited

U.S. PATENT DOCUMENTS

| | | | | |
|---|---|---|---|---|
| 2003/0124902 | A1* | 7/2003 | Wu | H01R 13/2457<br>439/500 |
| 2004/0192079 | A1* | 9/2004 | Lee | H01H 13/48<br>439/66 |
| 2008/0227307 | A1* | 9/2008 | Alden | H01R 12/714<br>439/66 |
| 2010/0068901 | A1* | 3/2010 | Yumi | H01R 13/03<br>439/78 |
| 2012/0217050 | A1* | 8/2012 | Kurita | H01R 12/57<br>174/261 |
| 2012/0302109 | A1* | 11/2012 | Qu | H01R 13/2442<br>439/884 |
| 2016/0126653 | A1* | 5/2016 | Kurita | H01R 13/02<br>439/884 |

FOREIGN PATENT DOCUMENTS

| | | |
|---|---|---|
| JP | H04(1992)-2464 U | 1/1992 |
| JP | 2004-002464 | 4/2004 |

* cited by examiner

CONTACT MEMBER

CROSS-REFERENCE TO RELATED APPLICATIONS

This application claims priority from Japanese Patent Application No. 2014-222985 filed with the Japan Patent Office on Oct. 31, 2014, the entire content of which is hereby incorporated by reference.

BACKGROUND

1. Technical Field

The present disclosure relates to a contact member.

2. Description of the Related Art

A contact member configured to contact two conductive members to electrically connect these conductive members to each other has been typically used. For example, a contact member described in Japanese Unexamined Utility Model Application Publication No. 04-002464 contacts a first member at a flat plate portion, and contacts a second member at an extension portion. The extension portion extends away from the first member to bend from the flat plate portion.

In the contact member of this type, the extension portion elastically deforms. Thus, contact pressure can be moderately increased. Moreover, even if there is a manufacturing error in the distance between both the members, the influence of such an error can be reduced. Thus, favorable contact between both the members can be realized.

SUMMARY

A contact member in one aspect of the present disclosure comprises: a thin plate member having spring characteristics and electrical conductivity. The thin plate member comprises: a joint portion having a joint surface to be joined to a first member; a contact portion contactable with a second member; and a connecting portion having a length component in a direction intersecting the joint surface, and having a first end continuous to the joint portion and a second end continuous to the contact portion. The connecting portion comprises a narrow portion having a smaller dimension in a width direction than a dimension around the narrow portion.

BRIEF DESCRIPTION OF THE DRAWINGS

FIGS. 1A to 1I are views for describing a contact member of a first embodiment, in which FIG. 1A is a front view of the contact member, FIG. 1B is a left-side view of the contact member, FIG. 1C is a right-side view of the contact member, FIG. 1D is a plan view of the contact member, FIG. 1E is a bottom view of the contact member, FIG. 1F is a perspective view of the contact member from the upper left side, FIG. 1G is a perspective view of the contact member from the upper right side, FIG. 1H is a perspective view of the contact member from the lower left side, and FIG. 1I is a perspective view of the contact member from the lower right side;

FIGS. 2A to 2C are front views for describing usage of the contact member of the first embodiment or modification of the contact member, in which FIG. 2A illustrates the contact member attached to an electronic board, FIG. 2B illustrates the contact member compressed by attachment of the electronic board to a casing, and FIG. 2C illustrates the modification of the contact member;

FIGS. 4A to 4C are views for describing a contact member of a second embodiment, in which FIG. 4A is a plan view of the contact member, FIG. 4B is a perspective view of the contact member from the upper left side, and FIG. 4C is a perspective view of the contact member from the lower right side;

FIGS. 6A to 6C are views for describing a contact member of a third embodiment, in which FIG. 6A is a plan view of the contact member, FIG. 6B is a perspective view of the contact member from the upper left side, and FIG. 6C is a perspective view of the contact member from the lower right side;

FIGS. 8A to 8C are views for describing a contact member of a fourth embodiment, in which FIG. 8A is a plan view of the contact member, FIG. 8B is a perspective view of the contact member from the upper left side, and FIG. 8C is a perspective view of the contact member from the lower right side;

DETAILED DESCRIPTION OF THE PREFERRED EMBODIMENTS

Figure 1F:
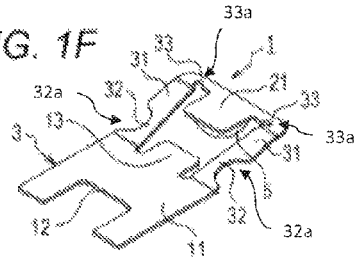
Figure 1D:
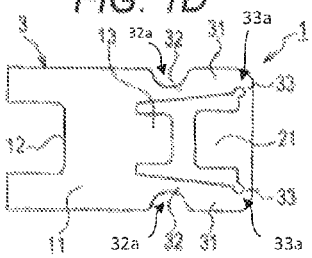
Figure 1G:
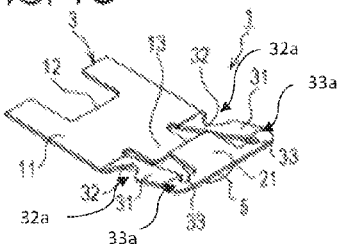
Figure 1B:
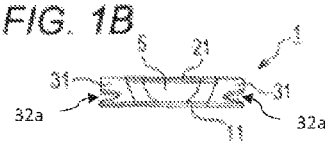
Figure 1A:
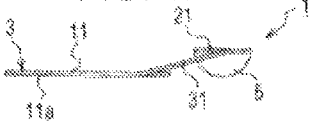
Figure 1C:
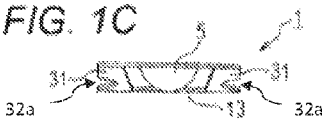
Figure 1H:
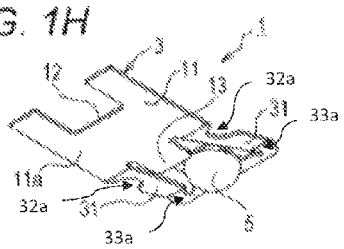
Figure 1E:
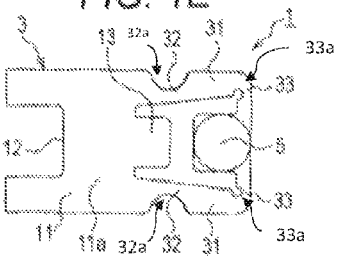
Figure 1I:
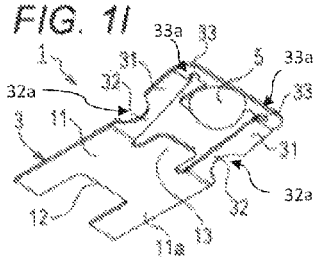

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
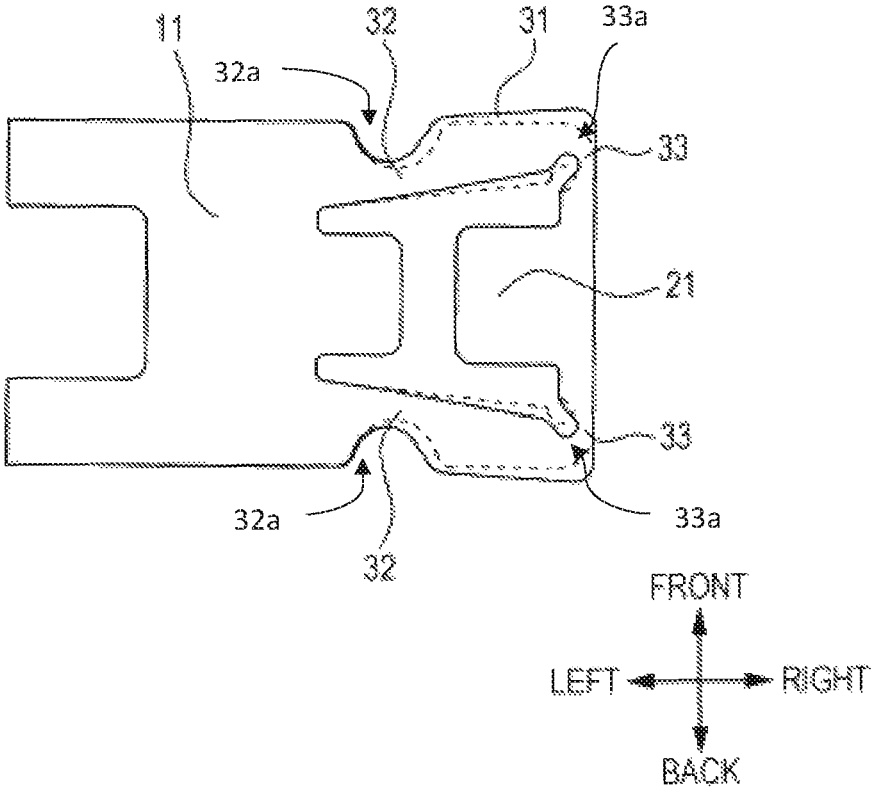
FIG. 3 is a plan view illustrating the compressed and deformed contact member of the first embodiment.

In the above-described contact member described in Japanese Unexamined Utility Model Application Publication No. 04-002464, when the extension portion elastically deforms, the contact member is displaced while warping across the entirety thereof and rotating about a connecting portion connected to the flat plate portion as illustrated in FIG. 3 of Japanese Unexamined Utility Model Application Publication No. 04-002464. Thus, the region of the contact member (the extension portion) contacting the second member moves away from the connection portion as viewed from the above. Such structural characteristics may cause a worse contact state.

For example, there is a probability that contact at a suitable position cannot be realized due to movement of the contact position between the second member and the contact member. Moreover, due to great friction force or the like, the contact member may deform without movement of the contact position between the contact member and the second member. In this case, great stress is generated inside the contact member. As a result, the contact member may be damaged, or the contact member and the first member joined together may be detached from each other. This might worsen the contact state.

It is preferable that one aspect of the present disclosure can provide a contact member which can suppress worsening of a contact state.

A contact member of an embodiment of the present disclosure comprises a thin plate member having spring characteristics and electrical conductivity. This contact member may be disposed between first and second members to electrically connect the first and second members to each other through the thin plate member, for example.

In the contact member, the thin plate member comprises: a joint portion having a joint surface to be joined to the first member; a contact portion contactable with the second member; and a connecting portion having a length component in a direction intersecting the joint surface, and having a first end continuous to the joint portion and a second end continuous to the contact portion. The connecting portion comprises a narrow portion having a smaller dimension in a width direction than a dimension around the narrow portion.

The contact member configured as described above easily elastically deforms at the narrow portion when a load is applied. An increase in the number of easily elastically deformable portions can enhance the entire flexibility of the contact member. Thus, stress concentration on a single point can be suppressed. This can reduce the risk of damaging the contact member and displacing the joint portion or the contact portion. As a result, the worsening of the contact state between the first and second members can be suppressed.

The contact member described above may further comprise an elastomer portion disposed on a back side of a region of the contact portion, the region being contactable with the second member. When the contact portion is displaced toward the first member, the elastomer portion may elastically deform between the contact portion and the joint portion or the first member.

According to the contact member configured as described above, the elastomer portion can increase the contact pressure of the contact portion. Note that the elastomer portion may contact the joint portion or the first member to restrain the movement of the contact portion in the direction parallel to the joint surface. In this case, the above-described problem leading to stress concentration is easily caused. However, with the above-described contact member, damage due to such a problem can be suppressed.

In the contact member described above, the connecting portion may comprise at least two narrow portions, and a width direction of one of the narrow portions may be different from a width direction of the other narrow portion.

In the contact member configured as described above, the elastically deformable directions of at least two narrow portions are different from each other. For this reason, the connecting portion is, across its entirety, elastically deformable in a complicated manner. This can more highly reduce the occurrence of damage of the contact member or the like.

In the above-described contact member, the connecting portions may be provided at two points, and the connecting portions at the two points may be symmetrical with respect to the contact portion.

In the contact member configured as described above, when the contact portion is displaced, the shapes of two connecting portions change similarly. Thus, the contact portion can be favorably brought into contact with the second member.

In the above-described contact member, a through hole may be provided at the region of the joint portion having the joint surface. In the contact member configured as described above, when the joint portion is joined to the first member with solder, the solder flows into the through hole. This can improve the joint strength, and reduce the inclination of the contact member, for example.

Exemplary embodiments of the present disclosure will be described below with reference to the drawings.

First Embodiment

(1) Entire Configuration

A contact member 1 of the present embodiment is surface-mounted on an electronic board by an automatic mounting machine. When the electronic board is assembled in a casing, the contact member 1 is brought into contact with the casing. Thus, the contact member 1 electrically connects the electronic board and the casing.

As illustrated in FIGS. 1A to 1I, the contact member 1 comprises a thin plate member 3 having spring characteristics and electrical conductivity, and a silicone resin 5 adhering to the thin plate member 3. Examples of the conductive thin plate member 3 having spring characteristics and electrical conductivity include: copper alloy having excellent spring elasticity, such as phosphor bronze, brass, nickel silver, beryllium copper, and nickel alloy; stainless steel; and spring steel. For example, copper and/or nickel can be also used for the thin plate member 3.

The thin plate member 3 comprises a joint portion 11, a contact portion 21, and connecting portions 31. These portions are formed in such a manner that pressing including punching and bending is performed for a single piece of sheet-metal or metal foil.

One surface of the joint portion 11 is a joint surface 11*a*. The joint surface 11*a* is, by soldering, joined to the electronic board. A cut-out 12 is formed at one end portion of the joint portion 11. An extension portion 13 extending in a tongue shape is formed at the opposite end portion of the joint portion 11.

In the following description, a "back side" means a side close to the joint surface 11*a*. On the other hand, a "front side" means a side opposite to the joint surface 11*a*. Further, a "height" indicates a distance in the normal direction of the joint surface 11*a*. The height increases with an increase in the distance from the front side of the joint surface 11*a*. In addition, when simply referred to as a "normal direction," such a normal direction means the normal direction of the joint surface 11*a*.

In the following description, the vertical direction is coincident with the normal direction. A direction toward the front side of the joint surface 11*a* points upward in the normal direction. Note that these directions are used merely for the sake of simplicity of description. An actual usage of the contact member 1 is not limited to these directions.

The contact portion 21 is a portion contactable with the casing. The contact portion 21 is disposed parallel to the joint surface 11*a* with a space formed above the joint surface 11*a*. The silicone resin 5 is disposed on the back surface of the contact portion 21. The silicone resin 5 is in a substantially hemispherical shape. The silicone resin 5 adheres, at a cross section of a sphere, to the contact portion 21. The height of a protruding tip end of the silicone resin (a sphere) 5 is substantially the same as that of the joint surface 11*a*.

The silicone resin 5 is disposed behind the contact portion 21 as viewed from the above. That is, the width of the silicone resin 5 is smaller than that of the contact portion 21. It can be said that the contact portion 21 has an area that can include the cross section of the silicone resin 5. The silicone resin 5 is molded on the contact portion 21, and adheres to the contact portion 21 by its own adhesive force.

Each connecting portion 31 is a portion formed in an L-arm shape as viewed from the above. One end of the connecting portion 31 is continuous to the joint portion 11, and the other end of the connecting portion 31 is continuous to the contact portion 21. As clearly illustrated in FIG. 1A, the connecting portion 31 has a length component in the direction (the height direction) intersecting the joint surface 11*a*.

The connecting portions 31 are provided respectively at two points to extend respectively from both sides of the extension portion 13. The connecting portions 31 are symmetrical with respect to the contact portion 21.

First and second narrow portions 32 and 33 having smaller dimensions in a width direction than those therearound are formed at each connecting portion 31. The "width direction" described herein means the direction intersecting the length direction of the connecting portion 31 (i.e., the direction in which the connecting portion 31 extends). That is, in the case of the L-shaped connecting portion 31 as in the present embodiment, the width direction of the connecting portion 31 is different between the front and back (both sides) of a bent portion of the L-shaped connecting portion 31. In other words, the width direction of the first narrow portion 32 and the width direction of the second narrow portion 33 are different from each other.

The first narrow portion (an intermediate narrow portion) 32 is formed closer to the joint portion 11 than the second narrow portion 33. That is, the first narrow portion 32 is provided between the joint portion 11 and the second narrow portion 33. A semicircular (arc-shaped) cut-out (or recess) 32*a* is formed at an outer portion of the first narrow portion 32, i.e., at an outer edge portion of the contact member 1. Thus, the first narrow portion 32 has a smaller dimension in the width direction than that therearound. Note that the inner side of the connecting portion 31, the first narrow portion 32, and the second narrow portion 33 is opposite to the outer edge side of the contact member 1, for example.

Each second narrow portion 33 is provided at an end portion of the connecting portion 31 closer to the contact portion 21. That is, the second narrow portion 33 is provided at the bent portion of the L-shaped connecting portion 31. A circular (arc-shaped) cut-out (or recess) 33*a* is formed inside such a bent portion. Thus, the second narrow portion 33 has a smaller dimension in the width direction than that therearound.

(2) Usage and Deformation of Contact Member

Figure 2A:
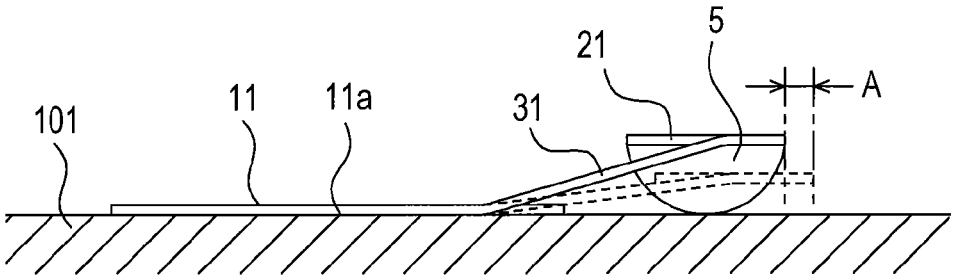

As illustrated in FIG. 2A, the contact member 1 is attached to an electronic board 101 in such a manner that the joint surface 11*a* is joined to the electronic board 101 by soldering (solder is not shown in the figure). The contact portion 21 is not fixed. Thus, the contact portion 21 is displaceable between the position close to the electronic board 101 and the position apart from the electronic board 101 such that the distance between the contact portion 21 and the electronic board 101 changes.

Suppose that only a load toward the electronic board 101 is applied to the contact portion 21. In this case, in response to deformation of the thin plate member 3, the contact portion 21 moves, as indicated by dashed lines in FIG. 2A, in the direction perpendicular to the normal line of the joint surface 11*a*. In the example illustrated in FIG. 2A, the contact portion 21 moves in the direction perpendicular to the normal line by the length indicated by arrows A.

Figure 2B:
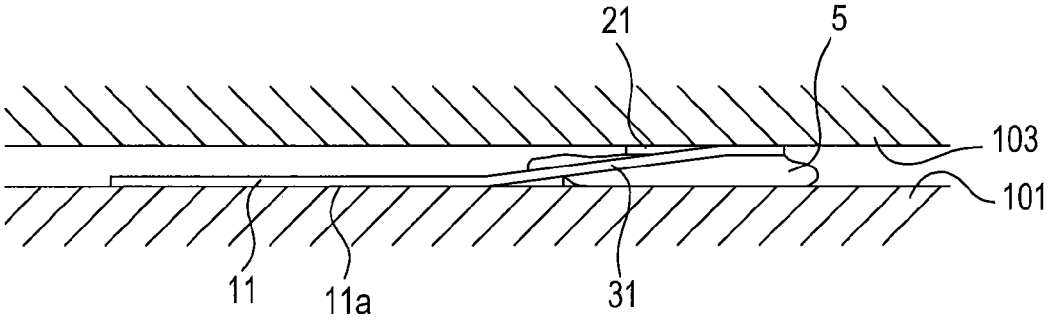

FIG. 2B illustrates the contact member 1 compressed by attachment of the electronic board 101 to a casing 103. The contact portion 21 is pressed by the casing 103, and is displaced toward the electronic board 101. The silicone resin 5 elastically deforms to be thinner.

Unlike the state indicated by the dashed lines in FIG. 2A, the contact portion 21 does not move by the length indicated by the arrows A. The contact portion 21 moves, along the normal direction, downward from the position indicated by solid lines in FIG. 2A. This is because, unlike the above-described assumption, the friction force between the contact portion 21 and the casing 103 and tackiness (an anti-slip function by adhesiveness) of the silicone resin 5 act on the contact portion 21 to suppress the contact portion 21 from moving in the direction different from the normal direction.

The regions (the first narrow portion 32 and the second narrow portion 33) which are more elastically deformable than the region therearound are formed at each connecting portion 31. Thus, the connecting portions 31 elastically deform when a load is applied in the direction intersecting the normal direction.

FIG. 3 is a plan view of the thin plate member 3 in the state illustrated in FIG. 2B. In FIG. 3, solid lines indicate the shape of the connecting portions 31 after change, and dashed lines indicate the shape of the connecting portions 31 before change. When the contact portion 21 moves along the normal direction, a load is applied to the connecting portions 31 in such a direction that the connecting portions 31 are compressed in the right-left direction as viewed in FIG. 3. At this point, the first narrow portions 32 deform such that part of each first narrow portion 32 on a cut-out side, i.e., an opening side, is narrowed. On the other hand, the second narrow portions 33 deform such that part of each second narrow portion 33 on the opening side expands.

The pattern of deformation of the contact member 1 caused when a load is applied to the contact member 1 is determined depending on various factors such as the material of the thin plate member 3, the thickness of the thin plate member 3, and a cut-out depth. Thus, a contact member seemed to have a similar shape to that of the contact member 1 does not always deform as in the contact member 1. The same applies to the following embodiments.

(3) Effects

In the contact member 1 configured as described above, the first narrow portions 32 and the second narrow portions 33 are easily elastically deformable. This improves the flexibility of the entirety of each connecting portion 31.

When the contact portion 21 moves in the normal direction of the joint surface 11*a* to approach the electronic board 101, the distance between the joint portion 11 and the contact portion 21 decreases. Thus, great stress is generated on the connecting portions 31. However, the connecting portions 31 have a high flexibility, which suppresses the contact member 1 from plastically deforming, and suppresses part of the joint portion 11 soldered to the electronic board 101 from detaching. With this configuration, the risk of worsening the contact state between the electronic board 101 and the casing 103 can be reduced.

The contact member 1 comprises the silicone resin 5 on the back surface of the contact portion 21. When the electronic board 101 is attached to the casing 103, the silicone resin 5 is compressed. As a result, the elastic reactive force of the silicone resin 5 assists the elastic force of the connecting portions 31 to increase the contact pressure of the contact portion 21. With this configuration, a contact state between the electronic board 101 and the casing 103 can be favorably maintained.

In the contact member 1, the cut-outs of the first narrow portions 32 and the second narrow portions 33 are in a substantially circular (arc) shape. The edge of each cut-out of the first narrow portions 32 and the second narrow portions 33 defines a smooth arc shape relative to a principal surface of the connecting portion 31.

With this configuration, when the first narrow portions 32 and the second narrow portions 33 deform, it is less likely that stress is concentrated on a single point. Thus, the first narrow portions 32 and the second narrow portions 33 are deformable across a large area thereof. As a result, the occurrence of damage of the contact member 1 can be reduced. Note that if each cut-out is formed with a sharpened inner end, a load is concentrated on such an inner end portion. As a result, the inner end portion easily bends beyond a yield point. On the other hand, such a risk is small in the contact member 1.

In the contact member 1, the direction of the smallest width is different between the first narrow portion 32 and the second narrow portion 33. In other words, the direction (the front-back direction in FIG. 3) along the shortest line of straight lines connecting one side to the other side of the first narrow portion 32 is different from the direction (the right-left direction in FIG. 3) along the shortest line of straight lines connecting one side to the other side of the second narrow portion 33.

When a load is applied to the thin plate member 3, the thin plate member 3 is deformable mainly on portions having the smallest dimensions in the width direction. That is, the direction in which deformation is easily caused is different between the first narrow portion 32 and the second narrow portion 33. Thus, the connecting portion 31 can be, across its entirety, elastically deformable in a complicated manner. This can more highly reduce the damage on the contact member 1 or the like.

In each connecting portion 31 of the contact member 1, the cut-outs are formed respectively at both end portions intersecting the length direction of the connecting portion 31. This also allows the connecting portion 31 to elastically deform in a complicated manner.

In the contact member 1, two connecting portions 31 are symmetrical with respect to the contact portion 21. Thus, in displacement of the contact portion 21, the shapes of two connecting portions 31 similarly change. This suppresses twisting of the contact portion 21. As a result, the contact portion 21 can be favorably brought into contact with the casing 103.

(4) Correspondence Relationship

In the contact member 1, the silicone resin 5 is an example of an elastomer portion of the present disclosure. Moreover, the electronic board 101 is an example of a first member of the present disclosure, and the casing 103 is an example of a second member of the present disclosure.

Second Embodiment (1) Entire Configuration

Figure 4B:
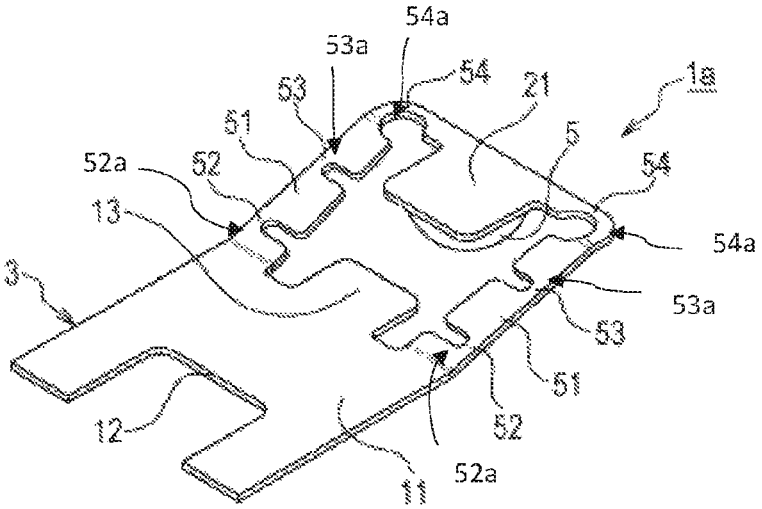
Figure 4A:
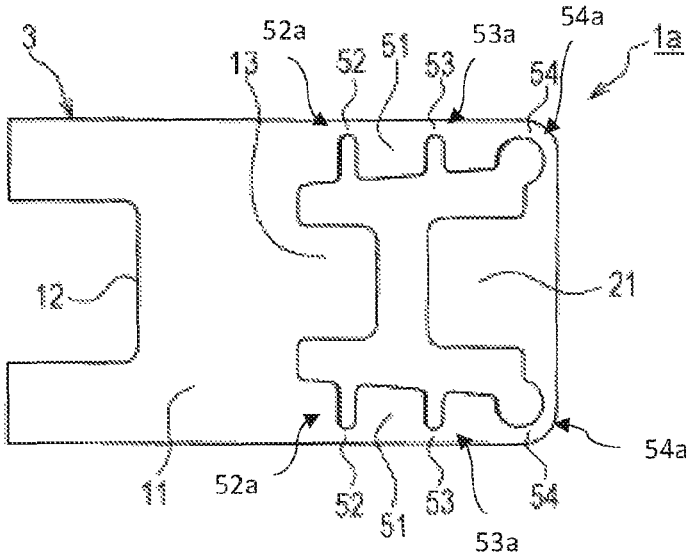
Figure 4C:
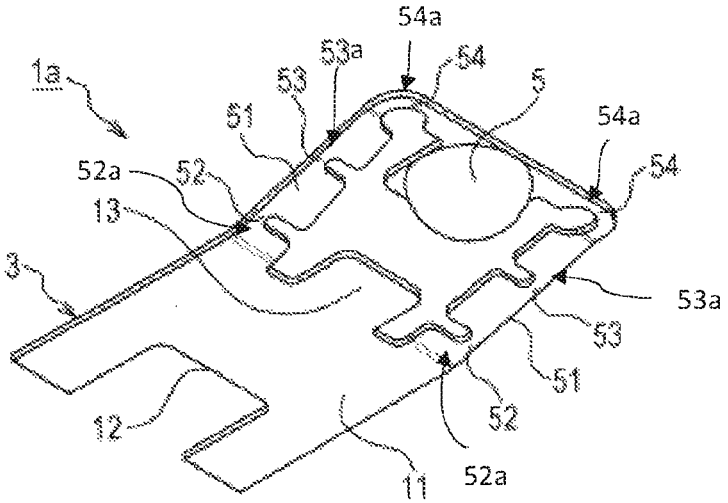

A contact member 1*a* of a second embodiment is illustrated in FIGS. 4A to 4C. Note that the contact member 1*a* has the same configuration as that of the contact member 1 of the first embodiment, except for the configuration of a connecting portion 51. For this reason, only points relating to the connecting portion 51 will be described below. The same reference numerals as those used in the first embodiment are used to represent equivalent elements in the second embodiment, and the description thereof will not be repeated.

Each connecting portion 51 comprises a first narrow portion (an intermediate narrow portion) 52, a second narrow portion (an intermediate narrow portion) 53, and a third narrow portion (an end narrow portion) 54.

The first narrow portion 52 and the second narrow portion 53 are arranged in the length direction of the connecting portion 51. That is, the first narrow portion 52 and the second narrow portion 53 are provided between a joint portion 11 and the third narrow portion 54. Slit-shaped cut-outs 52*a* and 53*a* are formed on opposing sides of two connecting portions 51, i.e., the inside of the connecting portions 51, at the first narrow portions 52 and the second narrow portions 53. Thus, each of the first narrow portions 52 and the second narrow portions 53 has smaller dimensions in the width direction than those therearound. Each slit is formed with an arc-shaped inner end.

Each third narrow portion 54 is provided at an end portion of the connecting portion 51 closer to a contact portion 21. That is, the third narrow portion 54 is provided at a bent portion of the L-shaped connecting portion 51. A circular (arc-shaped) cut-out 54*a* is formed inside the bent portion. Thus, the third narrow portion 54 has a smaller dimension in the width direction than that therearound.

(2) Effects

The contact member 1*a* of the embodiment can be also used in a similar manner to use of the contact member 1, and can also provide effects similar to those of the contact member 1.

Figure 5:
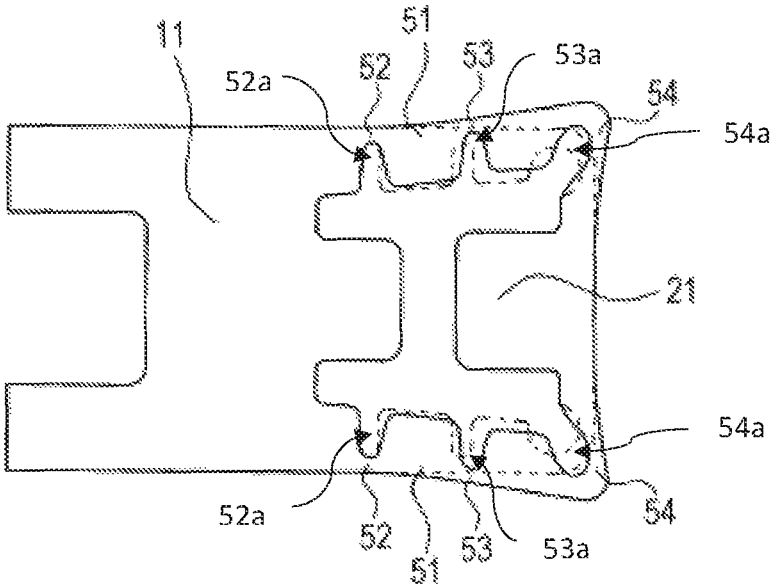
FIG. 5 is a plan view illustrating the compressed and deformed contact member of the second embodiment.

A change in the shape of the connecting portion 51 will be specifically described below. When the contact portion 21 moves downward along the normal direction, the first narrow portions 52 and the second narrow portions 53 deform, as illustrated in FIG. 5, such that each cut-out expands on the opening side thereof. On the other hand, the third narrow portions 54 deform such that each cut-out is narrowed on the opening side thereof.

Third Embodiment (1) Entire Configuration

Figure 6B:
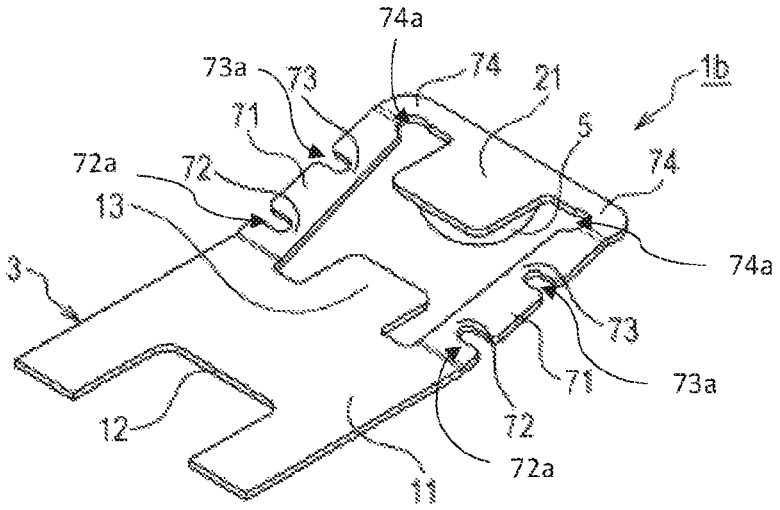
Figure 6A:
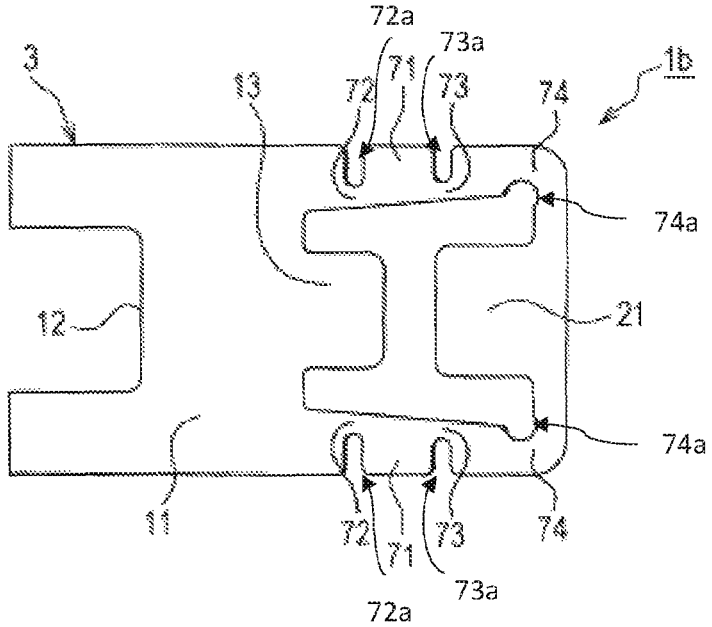
Figure 6C:
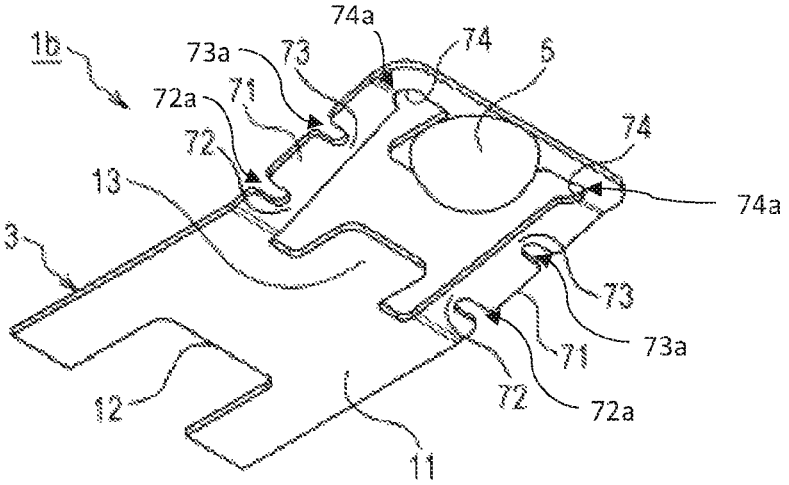

A contact member 1*b* of a third embodiment is illustrated in FIGS. 6A to 6C. Note that the contact member 1*b* has the same configuration as that of the contact member 1 of the first embodiment, except for the configuration of a connecting portion 71. For this reason, only points relating to the connecting portion 71 will be described below. The same reference numerals as those used in the first embodiment are used to represent equivalent elements in the third embodiment, and the description thereof will not be repeated.

Each connecting portion 71 comprises a first narrow portion (an intermediate narrow portion) 72, a second narrow portion (an intermediate narrow portion) 73, and a third narrow portion (an end narrow portion) 74.

The first narrow portion 72 and the second narrow portion 73 are aligned in the length direction of the connecting portion 71. That is, the first narrow portion 72 and the second narrow portion 73 are provided between a joint portion 11 and the third narrow portion 74. Slit-shaped cut-outs 72*a* and 73*a* are formed outside the first narrow portions 72 and the second narrow portions 73. Thus, each of the first narrow portions 72 and the second narrow portions 73 has a smaller dimension in the width direction than that therearound. Each slit is formed with an arc-shaped inner end.

Each third narrow portion 74 is provided at an end portion of the connecting portion 71 closer to a contact portion 21. That is, the third narrow portion 74 is provided at a bent portion of the L-shaped connecting portion 71. A circular (arc-shaped) cut-out 74*a* is formed inside the bent portion. Thus, the third narrow portion 74 has a smaller dimension in the width direction than that therearound.

(2) Effects

The contact member 1*b* of the embodiment can be also used in a similar manner to use of the contact member 1, and can also provide effects similar to those of the contact member 1.

Figure 7:
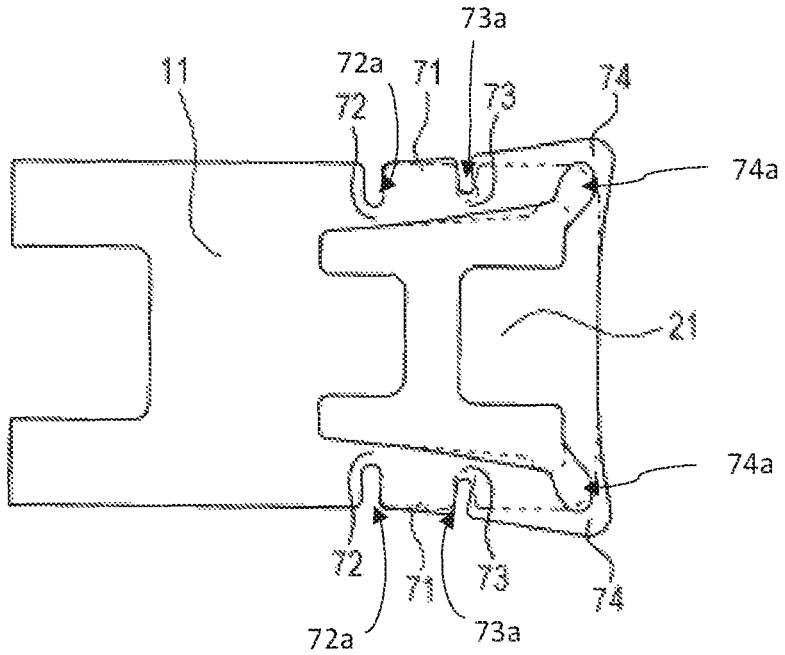
FIG. 7 is a plan view illustrating the compressed and deformed contact member of the third embodiment.

A change in the shape of the connecting portion 71 will be specifically described. When the contact portion 21 moves downward along the normal direction, the first narrow portions 72 and the second narrow portions 73 deform, as illustrated in FIG. 7, such that each cut-out is narrowed on the opening side thereof. On the other hand, the third narrow portions 74 deform such that each cut-out is narrowed on the opening side thereof.

Fourth Embodiment (1) Entire Configuration

Figure 8B:
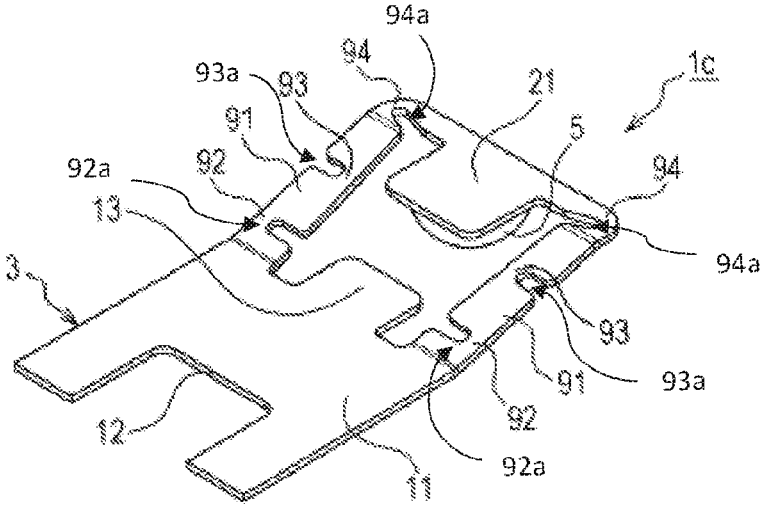
Figure 8A:
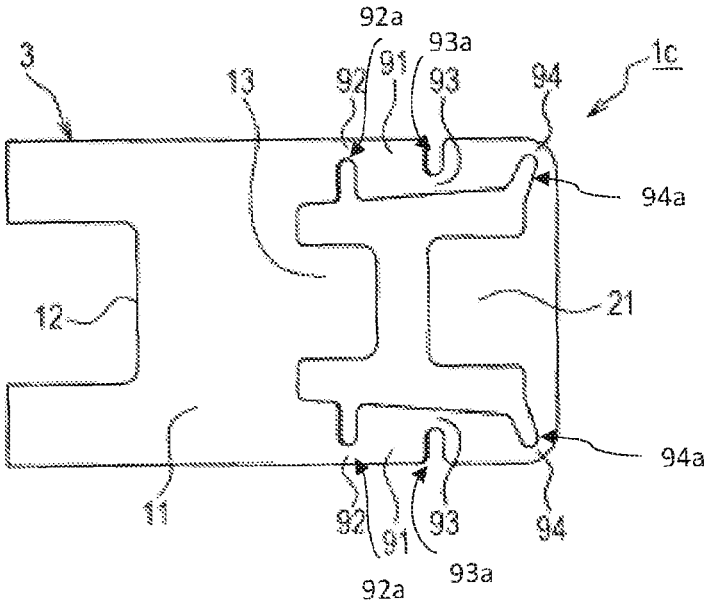
Figure 8C:
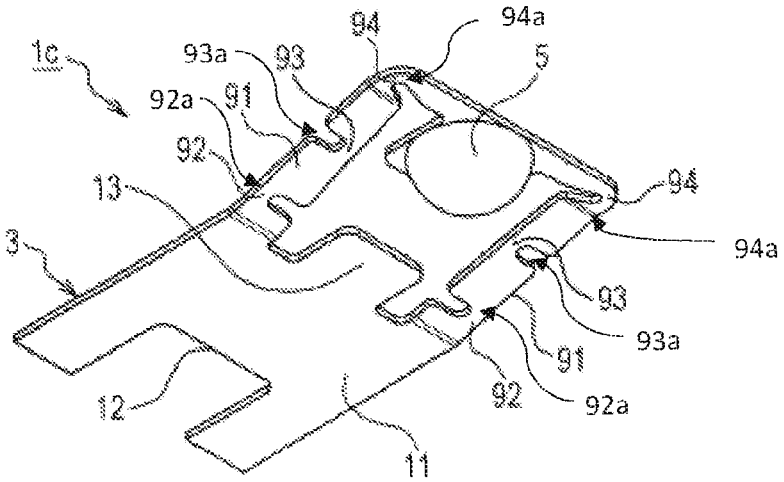

A contact member 1*c* of a fourth embodiment is illustrated in FIGS. 8A to 8C. Note that the contact member 1*c* has the same configuration as that of the contact member 1 of the first embodiment, except for the configuration of a connecting portion 91. For this reason, only points relating to the connecting portion 91 will be described below. The same reference numerals as those used in the first embodiment are used to represent equivalent elements in the fourth embodiment, and the description thereof will not be repeated.

Each connecting portion 91 comprises a first narrow portion (a first intermediate narrow portion) 92, a second narrow portion (a second intermediate narrow portion) 93, and a third narrow portion (an end narrow portion) 94.

The first narrow portion 92 and the second narrow portion 93 are aligned in the length direction of the connecting portion 91. That is, the first narrow portion 92 and the second narrow portion 93 are provided between a joint portion 11 and the third narrow portion 94. Slit-shaped cut-outs 92*a* are formed inside the first narrow portions 92. Thus, each first narrow portion 92 has a smaller dimension in the width direction than that therearound. Slit-shaped cut-outs 93*a* are formed outside the second narrow portions 93. Thus, each second narrow portion 93 has a smaller dimension in the width direction than that therearound. Each slit is formed with an arc-shaped inner end.

Each third narrow portion 94 is provided at an end portion of the connecting portion 91 closer to a contact portion 21. That is, the third narrow portion 94 is provided at a bent portion of the L-shaped connecting portion 91. That is, the slit-shaped cut-out 94*a* is formed inside the bend portion at the third narrow portion 94. Thus, each third narrow portion 94 has a smaller dimension in the width direction than that therearound.

(2) Effects

The contact member 1*c* of the embodiment can be also used in a similar manner to use of the contact member 1, and can also provide effects similar to those of the contact member 1.

Figure 9:
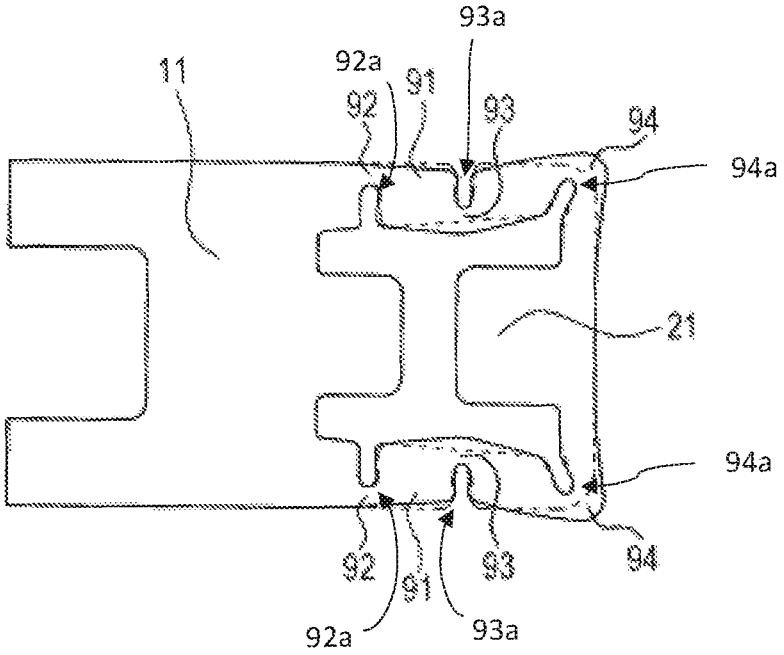
FIG. 9 is a plan view illustrating the compressed and deformed contact member of the fourth embodiment.

A change in the shape of the connecting portion 91 will be specifically described below. When the contact portion 21 moves downward along the normal direction, the first narrow portions 92, the second narrow portions 93, and the third narrow portions 94 deform such that each cut-out is narrowed on the opening side thereof as illustrated in FIG. 9.

Further, in each connecting portion 91 of the embodiment, the first narrow portion 92 and the second narrow portion 93 are formed respectively on opposing sides of a liner portion of the connecting portion 91. Thus, the deformation direction of the first narrow portion 92 and the deformation direction of the second narrow portion 93 are opposite to each other. As a result, the degree of deformation of the third narrow portion 94 can be decreased. That is, the first and second narrow portions 92 and 93 formed at each connecting portion 91 as described above suppresses part of the narrow portions from greatly deforming.

Other Embodiments

The embodiments of the present disclosure have been described above. The technique of the present disclosure is, needless to say, not limited to the above-described embodiments, and various embodiments falling within the technical scope of the present disclosure can be implemented. Note that the reference numerals of the components of the contact member 1 of the first embodiment will be used in the following description. However, the configurations described below can be employed in other embodiments.

Figure 2C:
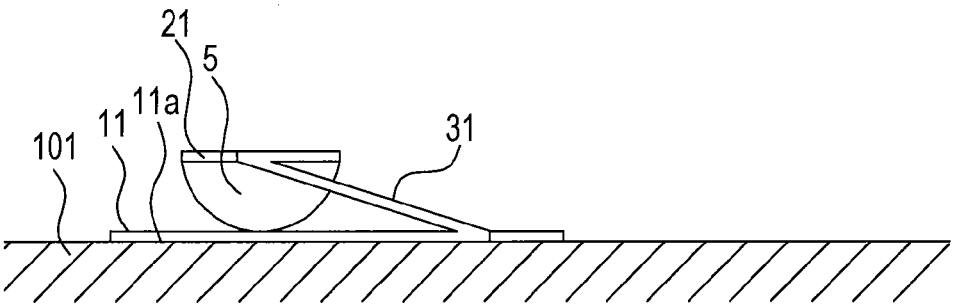

(a) The shapes of the joint portion 11, the contact portion 21, and the connecting portion 31 of the contact member 1 are not limited to those described in the above-described embodiments, and various shapes can be employed. For example, in the above-described embodiments, the configuration in which the angle between the connecting portion 31 and the joint portion 11 is an obtuse angle as viewed from the front has been described as an example. However, such an angle may be an acute angle. Specifically, as illustrated in FIG. 2C, the contact member 1 may have a shape in which the connecting portions 31 are bent such that the contact portion 21 is positioned above the joint portion 11.

Note that the joint portion of the present disclosure means a portion having a joint surface. The contact portion of the present disclosure mainly means a portion functioning to contact the second member (the casing 103). The connecting portion of the present disclosure means a portion mainly functioning to connect the joint portion and the contact portion.

That is, the contact member of the present disclosure may comprise at least portions serving as the joint portion, the contact portion, and the connecting portion. Thus, even in the case where part of the connecting portion contacts the second member, if the connecting portion has a function of connecting the separately-provided contact and joint portions to each other, such a connecting portion meets the requirements of the connecting portion of the present disclosure.

(b) In the above-described embodiments, the configuration in which the silicone resin 5 is used to increase the contact pressure has been described as an example. However, a material other than silicone resin may be used as the configuration (the material) for increasing the contact pressure, and various elastomers having elastic force can be used. Elastomer to which electrical conductivity is provided by mixing of filler or the like may be used as the configuration (the material) for increasing the contact pressure.

Moreover, in the above-described embodiments, the configuration in which the silicone resin 5 elastically deforms between the contact portion 21 and the electronic board 101 has been described as an example. Instead, the contact member 1 may be configured such that the silicone resin 5 is elastically deformed not between the contact portion 21 and the electronic board 101 but between the joint portion 11 and the contact portion 21.

(c) In the above-described embodiments, the contact member 1 comprising two connecting portions 31 has been described as an example. Instead, the contact member 1 may be configured to comprise a single connecting portion 31.

Figure 10:
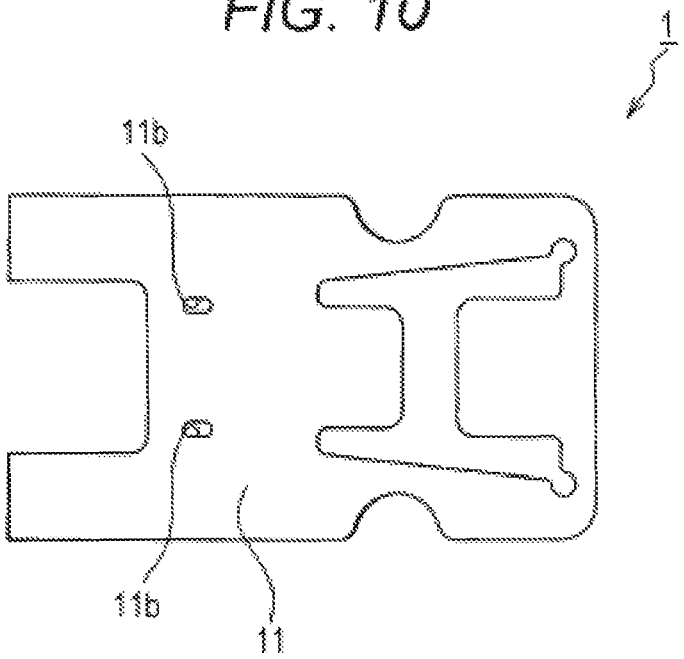
FIG. 10 is a view for describing a variation of the contact member.

(d) In the region (the region including the joint surface 11*a*) of the joint portion 11 forming the joint surface 11*a*, through holes 11*b* may be provided as illustrated in FIG. 10. Solder for joining the joint portion 11 and the electronic board 101 together can flow into the through holes 11*b*.

In some cases, the electronic board 101 and the contact member 1 are soldered together in such a manner that solder cream is applied to the electronic board 101 and then the solder cream is melted in a reflow furnace with the contact member 1 being placed on the solder cream. In this case, a process of placing the contact member 1 and a process of melting solder in the reflow furnace allow solder to flow through the through holes 11*b*.

At the process of placing the contact member 1, while the contact member 1 is sucked by a nozzle of the automatic mounting machine, the contact member 1 is pressed by the nozzle against the portion to which the cream solder is printed. Thus, extra solder escapes through the through holes 11*b*.

At the process of melting the solder in the reflow furnace, the melted solder flows through the through holes 11*b* regardless of whether or not the above-described pressing by the nozzle is performed. Since the solder flows through the through holes 11*b*, the electronic board 101 and the joint portion 11 are more firmly joined together. If the solder reaches the front side of the joint portion 11, such joint becomes much more firm. Further, since the solder is transferred upward through the through holes 11*b*, the inclination of the joint portion 11 due to the solder remaining between the joint surface 11*a* and the electronic board 101 is restrained.

In particular, if the contact member 1 is of a tiny size, the influence of inclination becomes greater and accordingly the through holes 11*b* have a profound effect.

Figure 11A:
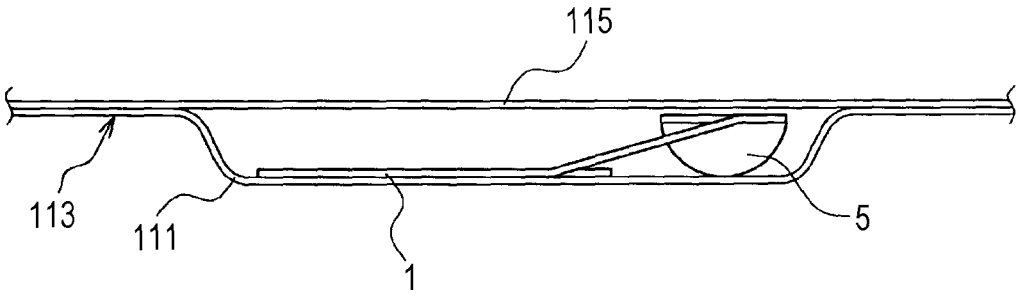
FIGS. 11A and 11B are views for describing a use example of the contact member.

(e) As illustrated in FIG. 11A, the contact member 1 can be housed in an embossed carrier tape 113 in which many housing recesses 111 are formed along the longitudinal direction, and can be supplied to the automatic mounting machine. At this point, the contact member 1 can be packed such that the silicone resin 5 is in contact with the bottom of the housing recess 111.

When the contact member 1 is packed as described above, the silicone resin 5 is in contact with the bottom of the housing recess 111. This suppresses the position displacement of the contact member 1 in the housing recess 111. As a result, failure in mounting of the contact member 1 by the automatic mounting machine can be reduced.

Figure 11B:
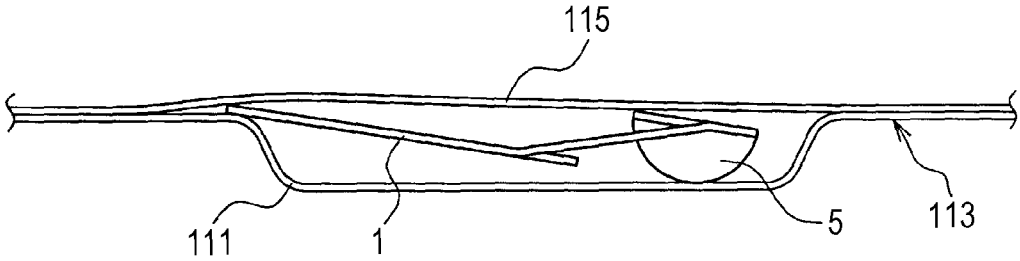

FIG. 11B illustrates, as an example of the position displacement, the state in which part of the contact member 1 is positioned over the housing recess 111. When the position of the contact member 1 is displaced as described above, it is difficult to properly take the contact member 1 out of the embossed carrier tape 113 by the automatic mounting machine, resulting in mounting failure. However, according to the contact member 1, such position displacement can be restrained.

In the case where silicone resin or other type of elastomer applied onto the back surface of the contact portion 21 has adhesiveness, the position displacement can be more highly restrained. The degree of adhesiveness may be such a degree that the contact member 1 can be dropped when a cover tape 115 is detached and the opening of the housing recess 111 faces down, for example.

(f) In the above-described embodiments, the configuration in which the contact member 1 is joined to the electronic board 101 and the casing 103 is brought into contact with the contact portion 21 has been described as an example. However, the target to which the contact member 1 is attached and the target with which the contact member 1 is in contact are not limited to the above-described components. For example, the contact member 1 may be joined to the casing 103. Further, the contact portion 21 may be in contact with other electronic board. The contact member 1 can be used in various situations where two members are electrically connected to each other.

In the present specification, the terms indicating shapes or states, such as spherical, circular, center, target, parallel, and perpendicular, mean not only precise shapes or states but also approximate shapes or states deviating from the precise shapes or states without losing the actions and effects of the present disclosure.

In the first embodiment, the direction (the front-back direction in FIG. 3) along the shortest line connecting two points, i.e., one side to the other side, of the first narrow portion 32 is different from the direction (the right-left direction in FIG. 3) along the shortest line connecting two points, i.e., one side to the other side, of the second narrow portion 33.

The contact member of the embodiments of the present disclosure may be any of first to fifth contact members described below.

The first contact member may be a contact member which comprises a thin plate member having spring characteristics and electrical conductivity and which is disposed between first and second members to electrically connect the first and second members through the thin plate member. The thin plate member comprises a joint portion having a joint surface to be joined to the first member, a contact portion contactable with the second member, and a connecting portion having a length component in a direction intersecting the joint surface, and having a first end continuous to the joint portion and a second other end continuous to the contact portion. The connecting portion comprises a narrow portion having a smaller dimension in a width direction than that therearound.

The second contact member may be the first contact member configured to further comprise an elastomer portion disposed on a back side of a region of the contact portion, the region being contactable with the second member. When the contact portion is displaced toward the first member, the elastomer portion may elastically deform between the contact portion and the joint portion or the first member.

The third contact member may be the first or second contact member configured such that the connecting portion comprises at least two narrow portions and that the width direction of one of the narrow portions is different from the width direction of the other narrow portion.

The fourth contact member may be any one of the first to third contact members configured such that the connecting portion comprises connecting portions at two points and that the connecting portions at the two points are symmetrical with respect to the contact portion.

The fifth contact member may be any one of the first to fourth contact members configured such that a through hole is formed at a region of the joint portion having the joint surface.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A contact member comprising:

a thin plate member having spring characteristics and electrical conductivity, and an elastomer portion, wherein the thin plate member comprises:

a joint portion having a joint surface to be joined to a first member, a contact portion contactable with a second member, and a connecting portion having a length component in a direction intersecting the joint surface, and having a first end continuous to the joint portion and a second end continuous to the contact portion, wherein the connecting portion comprises at least two narrow portions, each having a smaller dimension in a width direction than a dimension adjacent each of the narrow portions, and the width direction of one of the narrow portions being a different direction from the width direction of the other narrow portion, wherein the elastomer portion is disposed on a back side of an area of the contact portion, the area being contactable with the second member, and wherein the elastomer portion is configured to elastically deform between the contact portion and one of the joint portion and the first member, when the contact portion is displaced toward the first member.

2. A contact member comprising:

a thin plate member having spring characteristics and electrical conductivity, and an elastomer portion, wherein the thin plate member comprises:

a joint portion having a joint surface to be joined to a first member, a contact portion contactable with a second member, and a connecting portion having a length component in a direction intersecting the joint surface, and having a first end continuous to the joint portion and a second end continuous to the contact portion, and wherein the connecting portion comprises a narrow portion having a smaller dimension in a width direction than a dimension adjacent the narrow portion, wherein the connecting portion comprises connecting portions at two points, wherein the connecting portions at the two points are symmetrical with respect to the contact portion, wherein the elastomer portion is disposed on a back side of an area of the contact portion, the area being contactable with the second member, and wherein the elastomer portion is configured to elastically deform between the contact portion and one of the joint portion and the first member, when the contact portion is displaced toward the first member.

3. The contact member according to claim 2, wherein the connecting portion comprises at least two narrow portions, and a width direction of one of the narrow portions is different from a width direction of the other narrow portion.

4. The contact member according to claim 2, wherein the joint portion comprises a through hole in an area having the joint surface.

5. The contact member according to claim 1, wherein the connecting portion comprises connecting portions at two points, and the connecting portions at the two points are symmetrical with respect to the contact portion.

6. The contact member according to claim 2, wherein the narrow portion comprises:

an end narrow portion provided at an end portion of the connecting portion closer to the contact portion and configured to have an arc-shaped recess extending outward of the contact member, and an intermediate narrow portion provided between the joint portion and the end narrow portion and configured to have an arc-shaped recess extending inward of the contact member.

7. The contact member according to claim 2, wherein the narrow portion comprises:

an end narrow portion provided at an end portion of the connecting portion closer to the contact portion and configured to have an arc-shaped recess extending outward of the contact member, and two intermediate narrow portions provided between the joint portion and the end narrow portion and configured to have slit-shaped recess extending outward of the contact member.

8. The contact member according to claim 2, wherein the narrow portion comprises:

an end narrow portion provided at an end portion of the connecting portion closer to the contact portion and configured to have an arc-shaped recess extending outward of the contact member, and two intermediate narrow portions provided between the joint portion and the end narrow portion and configured to have slit-shaped recess extending inward of the contact member.

9. The contact member according to claim 1, wherein the joint portion comprises a through hole in a an area having the joint surface.

10. The contact member according to claim 2, wherein the narrow portion comprises:

an end narrow portion provided at an end portion of the connecting portion closer to the contact portion and configured to have a slit-shaped recess extending outward of the contact member, a first intermediate narrow portion provided between the joint portion and the end narrow portion and configured to have a slit-shaped recess extending outward of the contact member, and a second intermediate narrow portion provided between the joint portion and the end narrow portion and configured to have a slit-shaped recess extending inward of the contact member.

11. The contact member according to claim 5, wherein each of the narrow portions comprises:

an end narrow portion provided at an end portion of the connecting portion closer to the contact portion and configured to have an arc-shaped recess extending outward of the contact member, and an intermediate narrow portion provided between the joint portion and the end narrow portion and configured to have an arc-shaped recess extending inward of the contact member.

12. The contact member according to claim 5, wherein each of the narrow portions comprises:

an end narrow portion provided at an end portion of the connecting portion closer to the contact portion and configured to have an arc-shaped recess extending outward of the contact member, and two intermediate narrow portions provided between the joint portion and the end narrow portion and configured to have slit-shaped recess extending outward of the contact member.

13. The contact member according to claim 5, wherein each of the narrow portions comprises:

an end narrow portion provided at an end portion of the connecting portion closer to the contact portion and configured to have an arc-shaped recess extending outward of the contact member, and two intermediate narrow portions provided between the joint portion and the end narrow portion and configured to have slit-shaped recess extending inward of the contact member.

14. The contact member according to claim 5, wherein each of the narrow portions comprises:

an end narrow portion provided at an end portion of the connecting portion closer to the contact portion and configured to have a slit-shaped recess extending outward of the contact member, a first intermediate narrow portion provided between the joint portion and the end narrow portion and configured to have a slit-shaped recess extending outward of the contact member, and a second intermediate narrow portion provided between the joint portion and the end narrow portion and configured to have a slit-shaped recess extending inward of the contact member.

* * * * *